United States Patent [19]

Six

[11] 4,109,581

[45] Aug. 29, 1978

[54] PROJECTILE FOR AN INFANTRY RIFLE

[75] Inventor: Ludwig Six, Karlsruhe, Germany

[73] Assignee: Mauser-Werke Aktiengesellschaft, Germany

[21] Appl. No.: 140,291

[22] Filed: May 3, 1971

[30] Foreign Application Priority Data

Aug. 20, 1970 [DE] Fed. Rep. of Germany ..... 2041305

[51] Int. Cl.[2] ..... F42B 11/26

[52] U.S. Cl. ..... 102/92.1

[58] Field of Search ..... 102/92.1–92.7, 102/56, 52, 38, 39

[56] References Cited

U.S. PATENT DOCUMENTS

| | | | |
|---|---|---|---|
| 179,054 | 6/1876 | Pollard | 102/92.1 |
| 974,418 | 11/1910 | Muenzenmaier et al. | 102/92.2 |
| 3,154,016 | 10/1964 | Frey | 102/92.1 |
| 3,357,357 | 12/1967 | Voss | 102/92.3 |
| 3,442,216 | 5/1969 | Six et al. | 102/92.2 |

FOREIGN PATENT DOCUMENTS

| | | | |
|---|---|---|---|
| 791,516 | 9/1934 | France | 102/92.2 |

*Primary Examiner*—Verlin R. Pendegrass
*Attorney, Agent, or Firm*—McGlew and Tuttle

[57] ABSTRACT

The invention comprises a projectile for an infantry rifle or a light automatic weapon which comprises a solid projectile body made of soft iron made of an alloy of low carbon steels with less than 0.04% of carbon, 0.20% manganese, 0.05% to 0.18% of aluminium, 0.035% of phosphorus and 0.035% of sulphur, while the caliber is below 5.56 mm., preferably 4.00 mm.

5 Claims, 2 Drawing Figures

PROJECTILE FOR AN INFANTRY RIFLE

Figure 1:
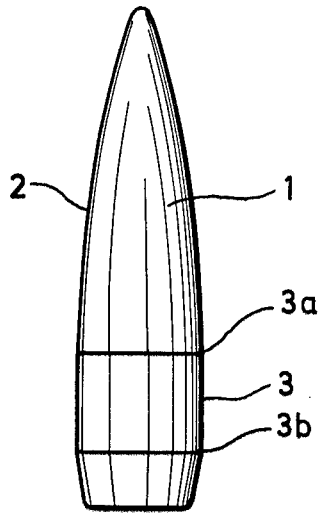

The invention relates to a projectile, particularly for infantry rifles or light automatic weapons.

The infantry projectiles previously known consist in general of a lead core and a projectile jacket surrounding the core and made of plated deep drawable sheet steel or of a brass alloy (Tombak). Such infantry munition has to meet a series of requirements. Thus, the munition—particularly in reference to automatic weapons and with the object of their better transport—should be as light as possible in order to increase substantially the number of cartridges which the infantryman may take along. In addition, as small as possible a recoil impulse is aimed at upon firing the projectile in order to be able to hold the weapon on target. For these reasons the caliber of the projectile was reduced and one changed from the calibers 7.0 to 8.0 mm. previously used to a substantially smaller caliber of 5.56 mm.

When using such small-caliber projectiles, the weight of the weapon and the munition is substantially decreased—which is very much to be desired—and also the recoil impulse upon firing of such cartridges has appreciable advantages over the cartridges with the calibers previously used.

A disadvantage not to be underestimated consists both with large-caliber munition-the caliber of the Nato projectile amounts to 7.62 mm.—as well as also with the small-caliber munition—the caliber of the projectile introduced by the U.S. Army amounts to 5.56 mm.—in this that the material "lead" which is used as lead core for the filling of the projectile is not present in a sufficient amount. It is generally known that the procurement of lead during times of crisis and war meets with appreciable difficulties. In addition the sources of the raw material of lead may be depleted in the foreseeable future.

The object of the present invention is a projectile which complies with the requirement mentioned in the foregoing to a far higher degree than heretofore was required of projectiles in that the projectile is made of a material which is available in sufficient quantities.

In accordance with the object of the invention, a small-caliber solid projectile is made of soft iron which has an extremely high starting speed and which in the range of the conically formed guide portion has a diameter which lies above the smallest rifling diameter of the barrel of the weapon. The soft iron of the solid projectile may in this connection consist of an alloy of low carbon steels containing less than 0.04% of carbon, 0.20% manganese, 0.05% to 0.18% of aluminium, 0.35% of phosphorus and 0.035% of sulphur. When employing this soft iron as a material for the projectile, the usual projectile jacket used with the known projectiles may be eliminated, so that a solid projectile is created. Of course, projectiles made of soft iron are subject to a lower cross-sectional load than for example projectiles with a lead filling or with a filling of still heavier materials, as the speed of the light projectile at greater distances drops more rapidly than the speed of a heavier projectile at the same starting speed. This is, however, of no importance with the battle distances now experienced.

In accordance with another object of the invention, the caliber of the solid projectile may lie below 5.56 mm., preferably, at about 4.0 mm. The caliber of the projectile may be reduced to a fargoing extent because no drawing steps are required during its production. The munition of the caliber 5.56 mm. as used by the U.S. Army still can be produced on the munition making machines presently in use. However, when still smaller calibers are to be produced as this is provided for according to the invention, difficulties arise with respect to the finishing, particularly during the drawing and pointing of the projectile jackets.

According to still another object of the invention, the starting speed of the light-weight solid projectile whose weight is below 1.6 g. may account to more than 1200 m/sec. Owing to the relatively low weight of the projectile, an extremely high starting speed is attainable so that good penetrations of solid bodies are produced, as they normally are attained solely with tank-penetrating infantry projectiles provided with hardened steel cores or hard cores. Obviously, at great distances the tank-pentrating infantry projectiles—considering their weight alone—are superior to the soft iron projectiles. One is, however, nowadays inclined to abandon and correspondingly to reduce the requirements as to long ranges which were earlier in use because for greater distances other weapons are available.

Tests have shown, that the new solid projectiles made of soft iron in accordance with the innovation, penetrate smoothly at a distance of 50 m. a steel plate having a thickness of 6 mm. (resistance ~ 150 kp/cm$^2$) at a firing angle of 67°. A similar smooth penetration was attained at 30 wooden boards (1 inch thick) at a distance of 100 m. Upon firing at a gelatine block a very favorable tumble effect could be established. The soft iron projectiles are water-bombardment-proof, that is they do not splinter. There were also attained very good plotted hits with the small-calibered solid projectiles.

According to a further object of the invention, the diameter of the solid projectile viewed in firing direction, in the fron range of the guiding portion may be 0.02 mm. and in the rear range 0.04 mm. larger than the smallest rifled diameter of the barrel of the weapon.

In the previously used projectiles which consist of a projectile jacket made of deep drawn steel sheet with copper, nickel or Tombak plating, and a lead filling in the projectile jacket, it is customary to so select the diameter of the guide portion that it is below the smallest rifled diameter of the barrel of the weapon. During the passage of the projectile through the barrel, the projectile is axially compressed by the gas pressure produced during the firing and this prevents a premature escape of the gases passed the projectile.

With the solid projectile according to the invention which is made of soft iron, such an axial compression is not possible. The material structure of the projectile remains practically unchanged when subjected to the gas pressure and when squeezed through the barrel, just as is the case with projectiles provided with a jacket. Since with the projectile according to the invention, no axial compression takes place during the passage through the barrel of the weapon, the diameter of the guide portion may be somewhat larger than the smallest diameter of the rifled bore of the barrel. Suitably, the projectiles are provided with a light coating of copper or nickel. This produces a protection against corrosion and a somewhat softer guidance of the projectile through the barrel takes place.

Figure 2:
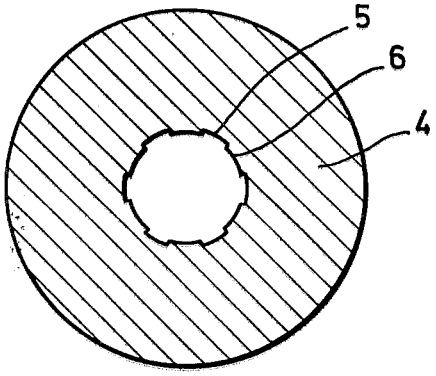

The drawing illustrates in an enlarged scale and by way of example the invention. In the drawings:

FIG. 1 shows a side elevation view of the solid projectile made of soft iron, and FIG. 2 is a cross-sectional view of the rifled portion of the barrel of the weapon intended for using the projectile of the invention.

Referring to FIG. 1 of the drawing, the infantry projectile 1 according to the invention consists of a small-calibered solid body made of soft iron, which in advance of start of the ogival portion 2 of the projectile is provided with a guide portion 3 formed slightly conically when viewed opposite the direction of movement of the projectile upon firing. In this manner, a slight increase in the diameter of the projectile is attained. Thus the diameter of the projectile in the front range 3*a* of the guide portion 3 is about 4.18 mm. and in the rear range 3*b* is about 4.2 mm.

The rifled barrel 4 shown in FIG. 2 is in the usual manner provided with several helical grooves 5 and lands 6, whereby the helix diameter amounts to about 4.16 mm. while the land diameter is about 4.0 mm.

The diameter of the guide portion 3 of the solid projectile 1 is therefore 0.02 to 0.4 mm. larger than the smallest rifled diameter of the barrel 4 and tests have shown that the projectile effects an absolute seal upon passage through the barrel, so that a premature escape of the gases past the projectile is prevented. Since a compression of the solid projectile during its passage through the barrel does not take place, a greater wear of the barrel does not occur.

In the infantry projectiles used previously, the depth of the rifling in barrel amounts to about 0.10 to 0.12 $^{m}$/m. With solid projectiles made of soft iron, this depth may be about 0.07 to 0.08 mm. as otherwise a greater wear of the barrel would take place. By means of a lesser depth of the rifling an advantage in the finishing of the barrel during its production is obtained.

What I claim is:

1. Projectile, particularly for infantry weapons and light automatic weapons, comprising a small-calibered solid projectile body made of soft iron with an extremely high starting speed, provided with a conical guide portion between its ends whose largest and smallest diameters are each greater than the smallest diameter of the rifling in the barrel of the weapon through which the projectile is intended to travel.

2. Projectile according to claim 1, in which the soft iron of the solid projectile comprises an alloy of low carbon steels with less than 0.04% of carbon, 0.20% manganese, 0.05% to 0.18% aluminium, 0.035% of phosphorus and 0.035% of sulphur.

3. Projectile according to claim 1, in which the caliber of the solid projectile is lower than 5.56 mm.

4. Projectile according to claim 1, in which the starting speed of the light-weight solid projectile is above 1200 m/sec.

5. Projectile according to claim 1, in which the diameter of the solid projectile viewed in firing direction and at the front of the guide portion is 0.02 mm. larger and at the rear of said guide portion is 0.04 mm. larger than the minimum diameter of the rifled barrel of the weapon.

* * * * *